US007448628B2

(12) United States Patent
Pedersen

(10) Patent No.: US 7,448,628 B2
(45) Date of Patent: Nov. 11, 2008

(54) GOLF BOARD GAME

(76) Inventor: Vagn S. Pedersen, 14 Kingston Hill Pl., Kingston Upon Thames (GB) KT2 7QY ( * ) Notice: Subject to any disclaimer, the term of this patent is extended or adjusted under 35 U.S.C. 154(b) by 66 days.

(21) Appl. No.: 11/697,587

(22) Filed: Apr. 6, 2007

(65) Prior Publication Data

US 2007/0235930 A1 Oct. 11, 2007

(51) Int. Cl.
*A63F 3/00* (2006.01)

(52) U.S. Cl. ..... 273/245; 273/259; 273/277

(58) Field of Classification Search ..... 273/244, 273/245, 259, 277
See application file for complete search history.

(56) References Cited

U.S. PATENT DOCUMENTS 3,826,498 A 7/1974 Monek
3,944,229 A 3/1976 Feeney
4,277,065 A 7/1981 White
4,364,569 A 12/1982 Duwell et al.
4,809,985 A 3/1989 Trimble
5,234,218 A 8/1993 LaRocca
5,924,693 A 7/1999 Beaumier et al.
2003/0025269 A1 2/2003 Stranger

*Primary Examiner*—Vishu K Mendiratta

(57) ABSTRACT

A golf board game including a game board resembling a golf course with 18 golf links and a club house along with various hazards, obstructions, lost ball, out-of-bounds, bridges and the like scattered throughout the game board. Also, provided are a die, tokens, a scorecard, a list card with a distances and outcome chart on one side, providing the number of spaces to be moved dependent upon the club and die roll or, for a putter, upon the distance the token is from the flag and die roll and, on the other side, a symbols and penalties chart providing strokes lost and location of next shot dependent upon various golf events, such as hazards, obstructions, lost ball, out-of-bounds, and bridges. The basic rules simulate those of a round of golf, thus educating players about the game of golf, golf etiquette, and friendly competition.

6 Claims, 8 Drawing Sheets

80

| DISTANCES AND OUTCOME | | | | | | |
|---|---|---|---|---|---|---|
| | EYES ON DIE: | | | | | |
| GOLF CLUBS | 1 | 2 | 3 | 4 | 5 | 6 |
| DRIVER | 10L | 10 | 11R | 11 | 12 | 12 |
| 3-WOOD | 9L | 9 | 10R | 10 | 11 | 11 |
| 5-WOOD | 8L | 8 | 9R | 9 | 10 | 10 |
| LONG IRON | 7L | 7 | 8R | 8 | 9 | 9 |
| MEDIUM IRON | 6 | 6 | 6 | 7 | 7 | 8 |
| SHORT IRON | 5 | 5 | 6 | 6 | 6 | 7 |
| PITCHING WEDGE | 3 | 4 | 4 | 5 | 5 | 6 |
| SAND IRON | STAY | 1 | 2 | 2 | 3 | 4 |
| LOB WEDGE | 1 | 2 | 2 | 3 | 3 | 3 |
| PUTTER | (SEE BELOW) | | | | | |

PUTTING

NUMBER OF SPACES ON THE GREEN FROM THE BALL TO THE FLAG:

| | | | | | | |
|---|---|---|---|---|---|---|
| 0 | 2-PUTT | 2-PUTT | 1-PUTT | 1-PUTT | 1-PUTT | 1-PUTT |
| 1 | 3-PUTT | 2-PUTT | 2-PUTT | 1-PUTT | 1-PUTT | 1-PUTT |
| 2 | 3-PUTT | 3-PUTT | 2-PUTT | 2-PUTT | 1-PUTT | 1-PUTT |
| 3-6 | 3-PUTT | 3-PUTT | 3-PUTT | 2-PUTT | 2-PUTT | 1-PUTT |

80 84 131

| SYMBOLS & PENALTIES | | | |
|---|---|---|---|
| SYMBOL | EVENT | STROKES LOST | NEXT SHOT TO BE TAKEN FROM |
| | Unplayable Ball | 1 | 2 spaces back on the numbered spaces |
| | Tree Obstruction | 0 | Play from space where it lies |
| | Water Hazard (except due to hook or slice) | 1 | 1 space behind the water hazard |
| | Water Hazard Due to Hook/Slice | 1 | 1 space behind the numbered space from where ball entered into the water |
| | Bridge Over Water Hazard | 1 | 1 space behind the water hazard |
| Lost Ball | Lost Ball | 1 | Spot where original ball was last played |
| | Out of Bounds (OB) | 1 | Spot where original ball was last played |
| | Bush/Lost | 1 | Play provisional ball from spot where original ball was played. Determine whether ball was lost/found by throwing die once and if a 1 is thrown, play ball as Lost Ball. (If provisional ball is played off the tee box space, the player has taken 3 strokes.) |
| | Non-rough area | | |
| B | Bunker | | |
| | | | |

130 132 133 134 135 136 137 138 139 140

FIG. 6

92

90

| SCORECARD | | | | | | | | | | | | | | | | | | | | | |
|---|---|---|---|---|---|---|---|---|---|---|---|---|---|---|---|---|---|---|---|---|---|
| Hole | 1 | 2 | 3 | 4 | 5 | 6 | 7 | 8 | 9 | Total | 10 | 11 | 12 | 13 | 14 | 15 | 16 | 17 | 18 | Total | 18-Hole Total |
| Par | 4 | 4 | 3 | 5 | 4 | 5 | 3 | 4 | 4 | 36 | 4 | 3 | 4 | 5 | 4 | 3 | 4 | 5 | 4 | 36 | 72 |
| Stroke Indexes | 10 | 5 | 6 | 12 | 2 | 13 | 18 | 5 | 7 | | 8 | 14 | 1 | 11 | 3 | 9 | 15 | 17 | 4 | | |
| Name-Handicap | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |
| | | | | | | | | | | | | | | | | | | | | | |

FIG. 7

94 90

| CLUB USE | |
|---|---|
| Short Iron | Recommended for playing out of fairway bunker ( a bunker 3 or more spces from the green), a rough area, or a single tree |
| Pitching Wedge | Recommended for playing out of a group of trees or bushes |
| Sand Iron | MUST be used to move out of greenside bunkers (bunkers placed 1 or 2 spaces from the green) |
| Putter | ONLY used on the green area |
| | |
| | |
| | |
| | |
| | |

FIG. 8

GOLF BOARD GAME

This application claims the benefit of my previously filed application Number 3024459 filed on Apr. 7, 2006 in Great Britain.

BACKGROUND OF THE INVENTION

Various types of games are known in the prior art. Prior art patents disclose games designed to give players a board game experience that relates to the game of golf. For example, U.S. patent application Ser. No. 2003/0025269 filed by Stranger and published on Feb. 6, 2003 teaches a golf board game apparatus comprised of a game board depicting a multiple of golf links each of which has a tee area, a fairway area, and a green area, and some of which have bush and hazards; two different decks of specialty cards which, depending on where the player is on the game board, can affect the number of strokes the player counts, and one of which can also affect the player's position on the game board, one standard six sided numbered die; one special six sided die with one of each of the numbers 1, 2, 3 marked on one of its faces, and one of those numbers marked on each of its remaining faces; and a second special six sided die with one of each of the words and phrases "Fairway", "Rough", "Sand", "Out of Bounds", marked on one of its faces, and one of those words or phrase marked on each of its remaining faces.

U.S. Pat. No. 5,234,218 issued to LaRocca on Aug. 10, 1993 provides a dice golf game having five dice wherein the dice represent various golf clubs and a roll of the die or dice determines the advancement of the ball. Specifically, five dice represent a driver, four a wood, three an iron, two a wedge and one a putter. Each die has six sides with three sides having a representation of a golf ball, two sides being blank and one side having a representation of a sand trap. Charts for tee shots, approach shots and putt shots have indicia corresponding to a roll of the die or dice for determining the advancement of a ball on each hole. The chart for tee shots include use of a driver, a wood and an iron. The chart for approach shots include use of a wood, an iron, and a wedge and the chart for putt shots include use of a putter.

U.S. Pat. No. 5,924,693 issued to Beaumier, et al. on Jul. 20, 1999 teaches a golf board game is comprised of a playing surface on which there is contained a plurality of designs representing golf links. Each golf link has a starting area, a fairway area and a green area. Distance indicating markers are provided on the fairway and green areas. At least one manually displaceable element is supportable on the playing surface. A first displacement indicating manually displaceable element is provided over the fairway area. A second displacement indicating element is also provided to cause displacement of the displaceable element towards an objective associated with the green area. Play money is associated with the golf game as well as a plurality of distinct groups of cards utilized to instruct a player under predetermined situations during play.

U.S. Pat. No. 4,364,569 issued to Duwell, et al. on Dec. 21, 1982 provides a parlor game closely simulating the outdoor game of golf. The game board is a scaled-down plan view of an actual golf course having tees, fairways, rough areas, trouble areas, and greens. The game provides a first series of variables according to the arbitrary choice of each player including club selection and the competence level of play. The game further provides a second series of variables determined by the roll of the dice including troubles encountered hole positions on the greens, and alternate fairway routes on certain fairways. After selecting an appropriate club from a CLUB CARD, a player places his associated token, according to the roll of the dice, on the fairway area, rough area, or trouble area. Appropriate indicia marks represent the yardage along the fairway in five-yard increments. As play proceeds, the token is advanced along the fairway according to the roll of the dice and encounters troubles along the way as determined from the dice and appropriate TROUBLE POSITION CARDS. By subsequent rolls of the dice and subsequent club selections, eventually, the player is able to place his token on the green; at this stage of the play, a HOLE POSITION CARD indicates the location of the ball on the green. By use of a PUTTING CARD upon subsequent rolls of the dice, the player ultimately sinks the ball in the hole and completes play to that hole.

U.S. Pat. No. 4,809,985 issued to Trimble on Mar. 7, 1989 teaches a golf game having at least one game board carrying a pictorial configuration of a multi-hole golf course including appropriate pictorial representations of a tee, a green with a boundary and distant from the tee, a hole on each green, a fairway generally extending between the tee and the green, and a plurality of hazards positioned adjacent to the fairway and to the green. At least one ball marker is provided to signify a golf ball of a player and adapted to be moved and positioned on the game board by a player after a golf shot. A plurality of dice, matrix type schedules, and distance/direction gauges are used to determine where golf shots come to rest. A method for playing a golf game which includes selecting a golf club and manipulating simultaneously a six-sided die and a twelve-sided die in order to randomly generate a pair of numbers that are used to determine the distance and direction of a golf shot from a pair of matrix type schedules. The method for playing a golf game additionally comprises plotting each golf shot.

U.S. Pat. No. 3,826,498 issued to Monek on Jul. 30, 1974 a golf game including a game board bearing designations of a golf hole including the tee, the green, the fairway and the rough. Yardage designations are on the game board as well as designations of hazards, penalties and bonuses. The game also includes four sets of distinguishable dice. The dice of two sets bear numerical indicia and one or more of the dice of each set may be rolled to generate a yardage indication. A table is provided designating various golf clubs and the dice of the first two sets that should be employed to obtain such yardage. The third and fourth sets of dice each consist of a single die, with the die of the third set bearing designations indicating whether a putt has been sunk or missed and the die of the fourth set having designations regarding shot direction.

U.S. Pat. No. 4,277,065 issued to White on Jul. 7, 1981 teaches a golf game comprises a board having at least one golf hole defined thereon, including a tee and a green. A coordinate system is defined on the board and includes a plurality of first lines extending from the tee to the green and a plurality of second lines disposed transversely relative to the first lines to intersect therewith. When the game is played, a player initially places a flag stick at a selected location on the green and thereafter sequentially rolls dice to determine the direction and distance his marker (ball) will be moved from the tee towards the green to simulate the flight and location of a golf ball on the board. Once the player's marker has reached the green, he then proceeds to roll further dice in his attempt to place the marker at the "hole" whereat the flag stick has been placed. Various obstacles and hazards are defined on the board to further test the player's ingenuity in playing the game.

U.S. Pat. No. 3,944,229 issued to Feeney on Mar. 16, 1976 teaches a board golf game shows a typical golf course including the shape and layout of the holes with both natural and artificial hazards so as to exactly duplicate conditions encountered on the golf course. Playing pieces are moved to one of differently positioned, non-aligned, and marked yardage points which give the exact lie of the ball. Dice, simulating clubs, and having different yardage values representing frequency and range of a given golf club, are selected and cast to obtain the yardage made by the stroke. This yardage is added to the previous yardage point value to determine total yardage and the corresponding yardage point to which the playing piece is to be moved. Yardage points are also located at typical ball locations on the course, including hazards such as water and traps, to closely duplicate playing conditions. Instructions on the board and two sets of trap cards give a variety of possible recovery shots which can be expected. A putting die gives the number of putts required to sink the ball after it lands on the green.

U.S. Pat. No. D226104 issued to Habuda on Jan. 23, 1973 provides an ornamental design for a golf game board.

FIELD OF THE INVENTION

The present invention relates to games, and more particularly, to a golf board game which is designed to provide a fun, new entertaining game that simulates a round of golf, while providing friendly competition and educating players about the game of golf and golf etiquette.

SUMMARY OF THE INVENTION

In view of the aforestated known types of golf board games now present in the prior art, the general purpose of the present golf board game, described subsequently in greater detail, is to provide a golf board game which has many novel features that result in a golf board game which is not anticipated, rendered obvious, suggested, or even implied by prior art, either alone or in combination thereof.

To accomplish this, the present golf board game consists of a game board, a token representing a golf ball, a list card, scorecards, and a die. The game board is imprinted with a club house and a number of rectangular spaces situated so as to replicate an 18-hole golf course. Each hole is numbered and its Par and Stroke Index are indicated at the tee. The distance to the flag is indicated by numbered spaces from the tee. The boundary of the green is indicated by an outer bold circle. Thus, for example, to the left of the club house is a square space labeled "Hole 1, Par 4, Index 10", said space representing a tee. To the left of the space labeled "Hole 1, Par 4, Index 10" are rectangular spaces sequentially numbered from 1 through 22. Various symbols appear within the numbered spaces. The symbols are listed and explained on the back of the scorecard. A numbered space bearing a flag represents a golf hole. On some holes with water hazards, there are parallel dashed lines imprinted on the game board, such dashed lines representing an alternative route to take from the tee, if the player prefers to do so. The player may choose a shorter and more risky route over a hazard or choose a longer and safer route around a water hazard. Before the player throws the die, the player must decide and declare which route he intends to follow. The list card represents a golf bag. The list card is imprinted with a list of ten clubs and possible distances and outcomes when playing with each of the clubs. The ten clubs listed are: a driver, a 3-wood, a 5-wood, a long iron, a medium iron, a short iron, a pitching wedge, a sand iron, a lob wedge, and a putter. The driver may be used from the tee when a player decides to do so. Other clubs may be played for certain circumstances as well. The movement of a token depends upon which club is selected by a player, the throw of the die, as well as the route chosen. The distances and outcomes chart provides the number of spaces and direction of movement based upon a club selected by a player and the number of eyes on the die.

The instant golf board game may be played an unlimited number of times by multiple players and players of a variety of ages. The present game is suitable for play by 1 to 4 players, which simulates the number of golfers in a real round of golf. The lightweight and portable golf board game can be easily transported to and played at almost any location. The limited number of parts simplifies storage of the present golf board game. The golf board game is compact for storage in limited space. The present golf board game is made of typical materials known in the art.

An alternative embodiment allows players to create their own distances and outcome table. Another embodiment provides stickers resembling flags, which the players put into position on the game board greens prior to game play. Yet another embodiment provides a method of playing the present game in a stroke play format. Still yet another embodiment provides a method of playing the present game in a match play format. Even still another embodiment provides a method of playing the present game with handicaps as in a real golf game. Additional embodiments provide the present game in an internet format, as a replica of specific golf courses, or various combinations of all of the foregoing embodiments. Also, other embodiment provide other symbols for trees 66, bushes 65, bunkers 68, and the like which may be substituted for those shown on said game board 20 as described and illustrated herein.

An object of the present golf board game is to entertain.

Another object of the present golf board game is to simulate a real golf game.

Yet another object of the present game is to educate players about the game of golf.

Still another object of the present golf board game is to promote good manners and teach golf etiquette to players.

Even still another object of the present golf board game is to provide a board game which may be played by players of wide range of ages.

Even yet another object of the present game is to provide friendly competition among players.

It is yet even a further object of the present golf board game to provide a game which is portable and compact for storage in small storage spaces.

Thus has been broadly outlined the more important features of the present golf board game and method so that the detailed description thereof that follows may be better understood and in order that the present contribution to the art may be better appreciated.

Numerous objects, features and advantages of the present golf board game will be readily apparent to those of ordinary skill in the art upon reading the following detailed description of presently preferred, but nonetheless illustrative, examples of the present golf board game and method when taken in conjunction with the accompanying drawings. In this respect, before explaining the current examples of the present golf board game and method in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the golf board game and method. It is therefore important that the claims be regarded as including such equivalent constructions insofar as they do not depart from the spirit and scope of the present invention.

Objects of the present golf board game and method, along with various novel features that characterize the invention are particularly pointed out in the claims forming a part of this disclosure. For better understanding of the golf board game and method, its operating advantages and specific objects attained by its uses, refer to the accompanying drawings and description.

BRIEF DESCRIPTION OF THE DRAWINGS FIGURES

FIG. 6 is a rear elevation view of a list card.

FIG. 7 is a front elevation of a scorecard.

FIG. 8 is a rear elevation of a scorecard.

DETAILED DESCRIPTION OF THE DRAWINGS

With reference now to the drawings, and in particular FIGS. 1 through 8 thereof, example of the instant golf board game employing the principles and concepts of the present golf board game and generally designated by the reference number 10 will be described.

Figure 1:
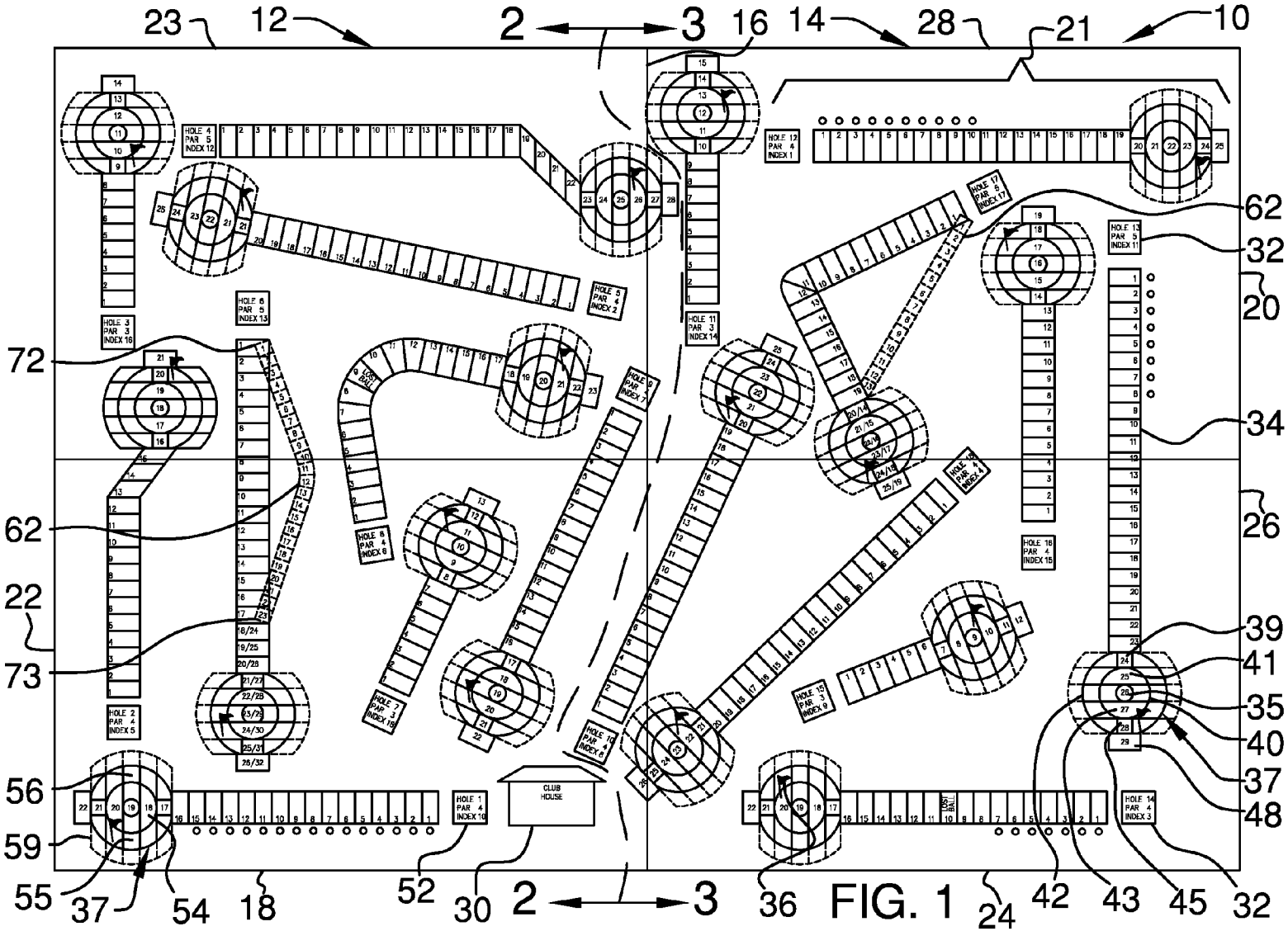
FIG. 1 is a top plan view of a game board according to the present golf board game.
Figure 2:
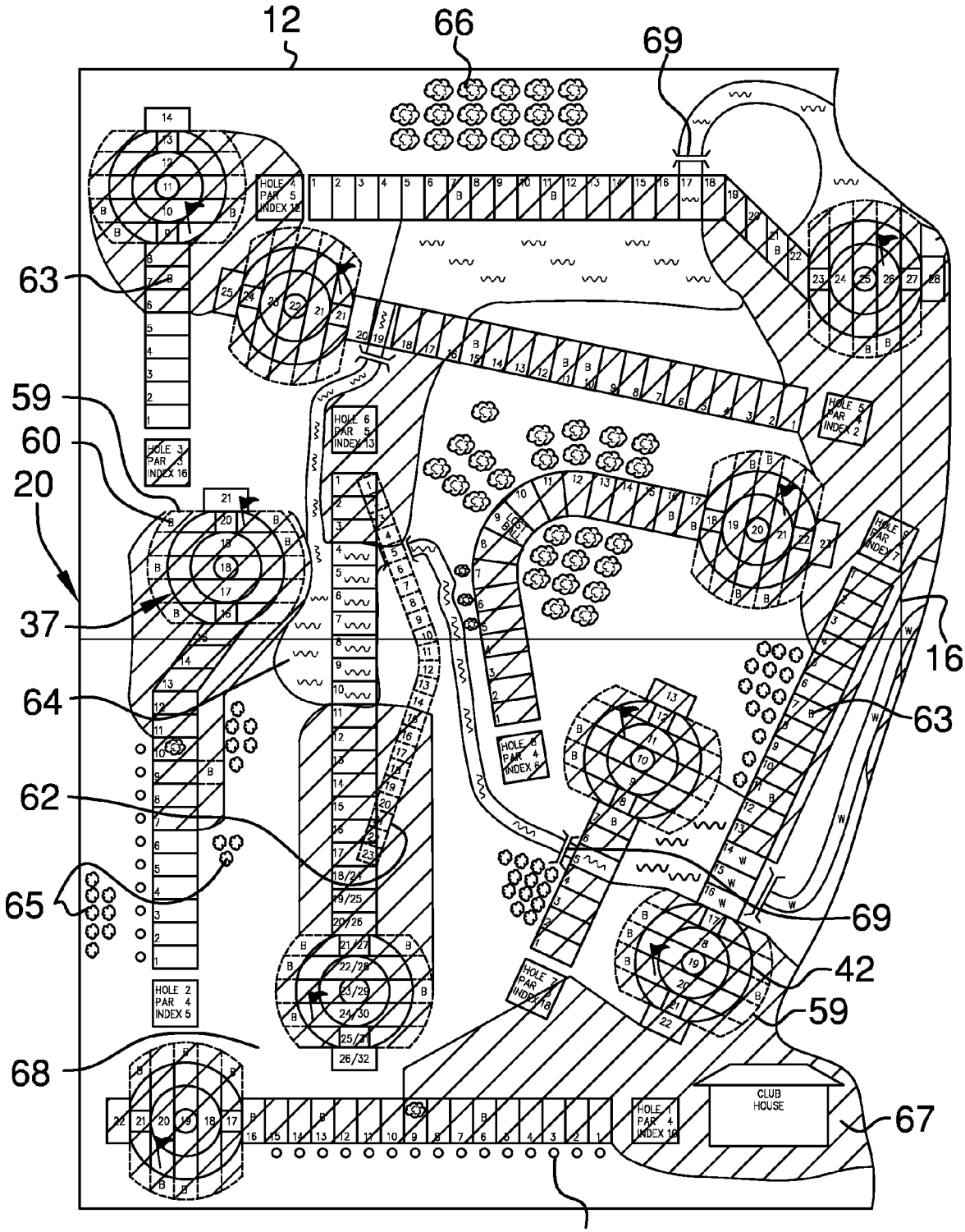
FIG. 2 is a top plan view of a left half portion of a game board illustrating terrain, hazards, and obstructions.
Figure 3:
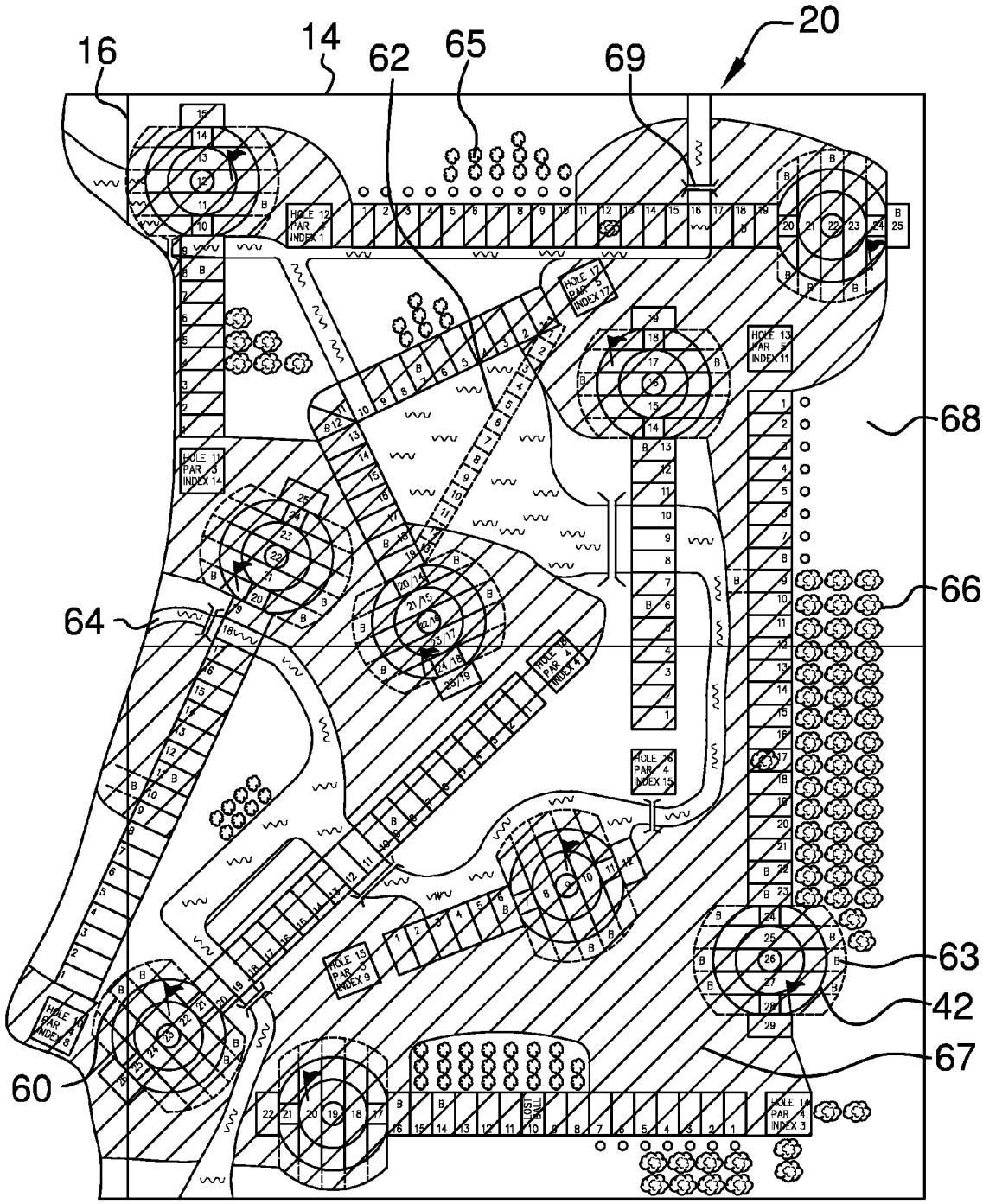
FIG. 3 is a top plan view of a right half portion of a game board illustrating terrain, hazards, and obstructions.
Figure 5:
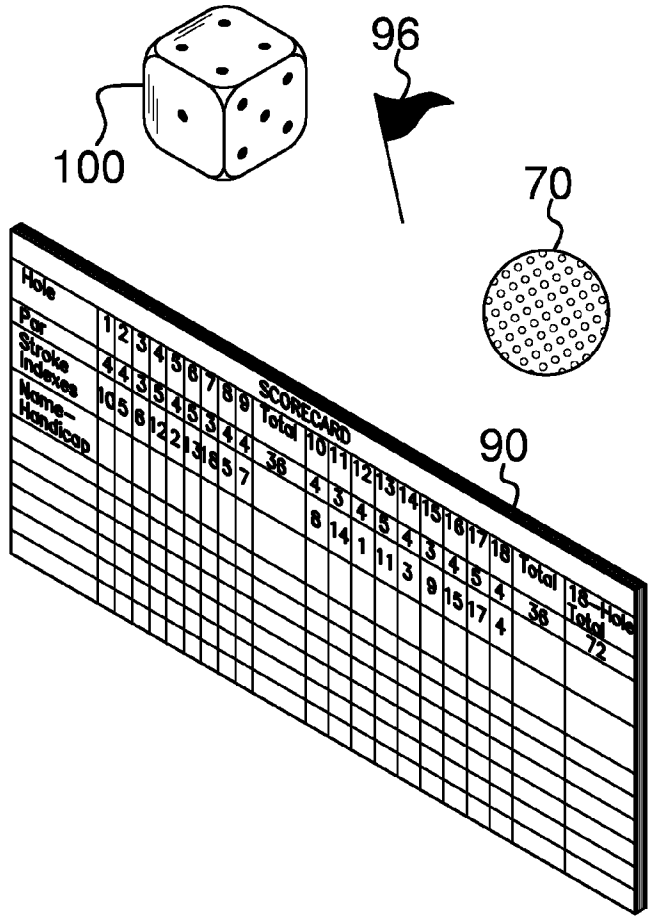
FIG. 5 is a top plan view of a list card and of a token and an isometric view of a die, a scorecard, and a stick-on flag of an alternative embodiment.

Referring to FIGS. 1 through 3 illustrate a preferred embodiment of the present golf board game 10 which comprises a rectangular game board 20, a plurality of tokens 70 representing a golf ball, a list card 80, a plurality of scorecards 90, and a die 100. Said game board 20 has a flat surface and comprises a left half portion 12 and a right half portion 14 continuously joined at a flexible seam 16. Said seam 16 accommodates folding together said left half portion 12 and said right half portion 14 of said game board 20 for transport and storage. Said game board 20 left half portion further comprises a left front edge 18, a left side edge 22, a left rear edge 23. Said right half portion 14 of said game board 20 further comprises a right front edge 24, a right side edge 26 and a right rear edge 28. Imprinted near said left front edge 18 and adjacent to said seam 16 of said game board 20 is a club house 30, which is in the form of a rectangular stick figure topped by a pentagon and which is imprinted with the indicia that represents a golf club house, such as the words "Club House". Eighteen golf links 21 are imprinted on said game board 20. Said golf links 21 are imprinted on said game board 20 to resemble a real golf course. Each golf link 21 is numbered and its Par and Stroke Index are indicated within a tee box space 32. Each golf link 21 is comprised of said tee box space 32, a plurality of fairway spaces 34, a green area 37 and a greenside area 59. Said fairway spaces 34 are sequentially numbered, starting with 1 for the fairway space nearest said tee box space 32, and represent distance to a flag 36 on a green area 37 from said tee box space 32. Each green area 37 is an obround grid comprised of a middle route 54, a left route 55 and a right route 56. A player must follow either the middle route 54, left route 55, or right route 56 in which a flag 36 is placed. Said green area 37 is formed of three concentric circles, one of which is a center space 35, an inner circle 40 surrounding said center space 35 and an outer circle 42. A square inner grid space 39 positioned within the outer circle 42, between the highest numbered fairway space 34 for a golf link 21 and said inner circle 40, divides said green area 37 into said right route 56 and said left route 55 and is the beginning step of the middle route 54. A semi-circular inner green space 41 is the next step of the middle route 54 and is situated between said inner grid space 39 and said center space 35. Said center space 35 is the third step of the middle route 54. The fourth step of the middle route 54 is a semi-circular outer green space 43, which is situated between said center space 35 and a square outer grid space 45. Said outer grid space is the next step of the middle route 54 and is situated between said outer green space 43 and a rectangular off-green space 48. Said off-green space 48 represents an area in which a golf ball is over-hit and is the last step of said middle route 54, said left route 55, and said right route 56. Said inner grid space 39, inner green space 41, center space 35, outer green space 43, outer grid space 45, and off-green space 48 are sequentially numbered along with said fairway spaces 34. A flag 36 is imprinted on each green area 37. An alternative embodiment provides a stick-on flag 96, as shown in FIG. 5, as an alternate to flags 36 imprinted on said game board 20 as shown in FIGS. 1, 2, and 3, thus allowing players to place flags according to their own imagination on said game board 20.

On said game board 20, an alternative route 62, represented by parallel dashed lines, is provided on the golf link 21 for Hole Number 6 and on the golf link 21 for Hole Number 17. Said alternative route 62 formed of fairway spaces 34 sharing a beginning space 72 with first fairway space of a golf link 21, continuing on a deviated path, and an ending space 73 with a fairway space of a golf link 21. Said alternative route 62 allows a player to choose between taking a longer and safer route around a water hazard 64 or a shorter and more risky route over a water hazard 64.

Referring to FIG. 2, said left half portion 12 of said game board 20 is illustrated. Said left half portion 12 generally contains golf links 21 representing holes 1 through 9. A golf link 21 representing hole 1 is located to the left of said club house 30. A first tee box space 52 for hole 1 is imprinted near said club house 30. Said first tee box space 32 contains the imprinted words "Hole 1", "Par 4", and "Index 10". Near said first tee box space 32 are sequentially-numbered first-hole fairway spaces 34 imprinted on said game board 20 representing distance from said first tee box space 32 to a first hole flag 36 located on a first hole green area 37. Said first hole green area 37 is adjacent to highest numbered first-hole fairway space 34. A flag 36 is located within said first hole green area 37. An alternative route 62 consisting of sequential playing spaces is shown running along side said fairway spaces 34 for the golf link 21 representing Hole 6. Said alternative route allows a player to choose a safer route, as opposed to a riskier route going over a water hazard 64, marked with 'w', lying over fairway spaces 24.

Various symbols, explained in FIG. 6, are imprinted on said game board 20 for hazards, obstructions, and terrain features as shown in FIGS. 2 and 3. For example, a plurality of bushes 65, each bush shown as X and a plurality of trees 66, each tree shown as a star, are imprinted on said game board 20 throughout non-rough areas 67, illustrated in stripes, and rough areas 68 and occasionally on a fairway space 34. Rough areas 68 are areas outside of fairway spaces 34, green areas 37 and greenside areas 59. A greenside area 59 is formed of spaces outside a green area 37 and adjacent to left route 55 spaces and right route 56 spaces of a green area 37. In addition, a plurality of fairway bunkers 63 and greenside bunkers 60, marked as "B", are placed on various fairway spaces 34 and said greenside areas 59, respectively. A plurality of water hazards 64, labeled as 'w', are imprinted so as to run throughout the game board 20 golf course. A plurality of out-of-bounds 61, illustrated as 'o', are distributed alongside various fairway spaces 34 in various golf links 21. A plurality of bridges 69, shown as, are placed across water hazards 64, near fairway spaces 34, throughout the game board 20 as well.

FIG. 3 illustrates a right half portion 14 of said game board 20, said right half portion 14 continuously bounded to said left half portion 12 (shown in FIGS. 1 and 2) at a seam 16. Said right half portion 14 of said game board 20 generally contains golf links 21 representing holes 10 through 18.

Figure 4:
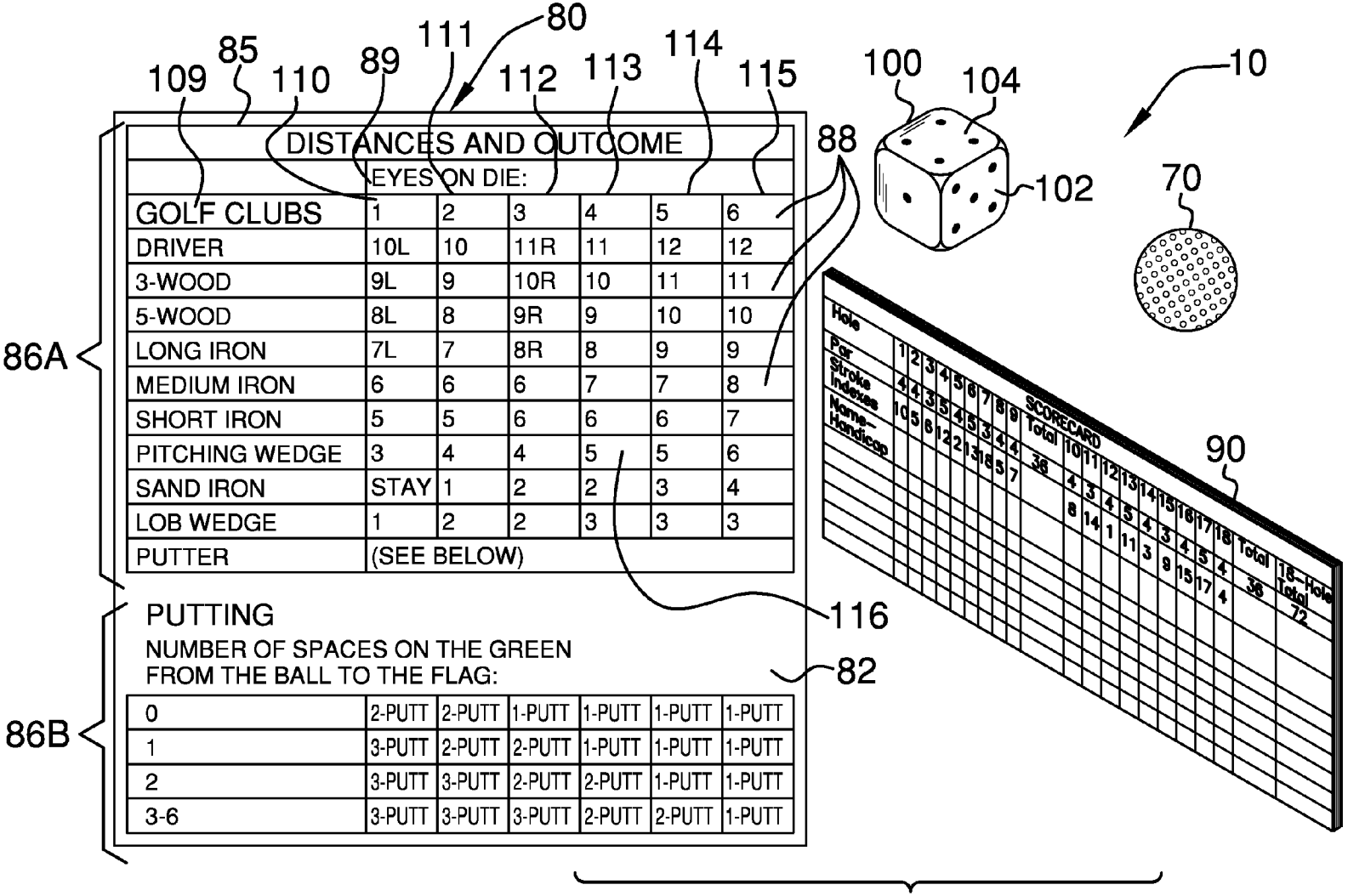
FIG. 4 is a front elevation view of a list card and of a token and an isometric view of a die and scorecard.

Referring to FIG. 4, a token 70, a list card 80, a scorecard 90, and a die 100 are illustrated. A plurality of tokens 70 having a surface resembling the dimples on a golf ball are provided as game pieces. Said cube-shaped die 100 has six faces 102. Each such face 102 bears a non-duplicated number of eyes 104, from 1 to 6. Said list card 80 is comprised of a front side 82 and a rear side 84, shown in FIG. 6. Said front side 82 of said list card 80 provides an example of a set of rules for the preferred embodiment of the present golf board game 10 described herein and illustrating in the drawings, such rules providing the number of spaces a player may move such player's token dependent upon 1) the number of eyes 104 facing upwardly on a face 102 of said die 100 after a player throws said die 100, 2) the number of spaces indicated in the distances and outcome table for the roll of the die 100, the club used by such player, and for a putter, the number of spaces on the green area 37 from the token 70 ball to the flag 36.

Said front side of said list card 80 is a chart 85 labeled "DISTANCES AND OUTCOME". Said chart 85 is divided into a first area 86*a* and a second area 86*b*. Said first area 86*a* and said second area 86*b* are divided into a club column 109 and six numbered columns—column1 110, column2 111, column3 112, column4 113, column5 114, column6 115. Said first area 86*a* is also divided into 11 rows 88. Each intersection of a club column 109 and numbered column1 110, column2 111, column3 112, column4 113, column5 114, column6 115 is a cell 116. Said club column 109 is labeled "GOLF CLUBS". Each row 88 lists a club selected from the group consisting of DRIVER, 3-WOOD, 5-WOOD, LONG IRON, MEDIUM IRON, SHORT IRON, PITCHING WEDGE, SAND IRON, LOB WEDGE, and PUTTER. Above the numbered columns 110, 111, 112, 113, 114, 115 is a titleline 89 labeled "EYES ON DIE:" Said numbered columns 110, 111, 112, 113, 114, 115 are labeled with sequential numbers selected from the group consisting of 1, 2, 3, 4, 5, and 6, respectively, representing the number of eyes 104 on said die 100 rolled. A cell 116 provides the number of spaces a token 70 is moved forwardly and comes to rest on a space straight ahead or to the right (R) or left (L) of such space. For a DRIVER, cells 116 below each numbered column 110, 111, 112, 113, 114, and 115 are labeled 10L, 10, 11R, 11, 12 and 12, respectively. For a 3-WOOD, cells below each numbered column are 9L, 9, 10R, 10, 11, and 11. For a 5-WOOD, the cells below each numbered column are labeled 8L, 8, 9R, 9, 10, and 10. For a LONG IRON, the cells below each numbered column are labeled 7L, 7, 8R, 8, 9 and 9. For a MEDIUM IRON, the cells below each numbered column are labeled 6, 6, 6, 7, 7, and 8. For a SHORT IRON, the cells below each numbered column are labeled 5, 5, 6, 6, 6, and 7. For a PITCHING WEDGE, the cells below each numbered column are labeled 3, 4, 4, 5, 5, and 6. For a SAND IRON, the cells below with each numbered column are labeled STAY, 1, 2, 2, 3, and 4. For a LOB WEDGE, the cells below each numbered column are 1, 2, 2, 3, 3, and 3. For a PUTTER, the cells below each numbered column are merged into one cell labeled (See Below), referring to said second chart 86 on said list card 80 front side 82.

Said club column 109 and numbered columns 110, 111, 112, 113, 114, 115 of said second area 86*b*, imprinted below said first chart 85 on said list card 80 front side 82, appear as extensions from said first area 86*a*, provide the number of moves for a token based upon the number spaces on the green area 37 a token 70 is from a flag 36. For a PUTTER located 0 green area 37 spaces from a flag 36, the cells 116 below each numbered column are labeled 2-PUTT, 2-PUTT, IN, IN, IN, and IN. For a PUTTER located 1 green area 37 space from a flag 36, the cells 116 below each numbered column are labeled 3-PUTT, 2-PUTT, 2-PUTT, IN, IN, and IN. For a PUTTER located 2 green area 37 spaces from a flag 36, the cells 116 below each numbered column are labeled 3-PUTT, 3-PUTT, 2-PUTT, 2-PUTT, IN and IN. For a PUTTER located at least 3 green area 37 spaces from a flag 36, but no more than 6 green area 37 spaces from a flag 36, the cells 116 below each numbered column are labeled 3-PUTT, 3-PUTT, 3-PUTT, 2-PUTT, 2-PUTT, and IN. An example of a set of rules for using each club according to the preferred embodiment of the present golf board game 10 described herein and illustrated in the drawings is imprinted on the back 94 of said scorecard 90, as shown in FIG. 8, discussed hereinbelow. In FIG. 7, more detail is provided with respect to a façade 92 of said scorecard 90.

FIG. 5 illustrates an alternative embodiment which provides a stick-on flag 96 in addition to a list card 80, a die 100, a plurality of scorecards 90, and a plurality of tokens 70. Said stick-on flag 96 allows players to determine flag placement according to their own imagination on said game board 20.

Referring to FIG. 6, the rear side 84 of said list card 80 is labeled "SYMBOLS & PENALTIES" and forms a grid of four columns labeled "SYMBOL", "EVENT", "STROKES LOST", and "NEXT SHOT TO BE TAKEN FROM" and ten rows labeled "", "", "W", "W", "", "Lost Ball", "o", "x", "", "B", and "". The cells across a first row 130, are labeled a blank space, "Unplayable Ball", "1", and "2 spaces back on the numbered spaces". The cells across a second row 132 contain" ", "Tree obstruction", "0", and "Play from where it lies". The cells across a third row 133 are labeled "W", "Water Hazard (except due to hook or slice)", "1", and "1 space behind the water hazard". The cells across a fourth row 134 are labeled ""W", "Water Hazard Due to Hook/Slice", "1", and "1 space behind the numbered space form where ball entered into the water". The cells across a fifth row 135 are labeled blank, "Bridge Over Water Hazard", "1" and "1 space behind the water hazard". The cells across a sixth row 136 are labeled "Lost Ball", "Lost Ball", "1", and "Spot where original ball was last played". The cells across a seventh row 137 are labeled "o", "Out of Bound (OB)", "1" and "Spot where original ball was last played". The cells across an eighth row 138 are labeled "X", "Bush/Lost", "1", and "Play provisional ball from spot where original ball was played. Determine whether ball was lost/found by throwing die once and if a 1 is thrown, play ball as Lost Ball. (If provisional ball is played off the tee box space, the player has taken 3 strokes.)" The cells across a ninth row 139 are labeled"", "Non-rough are", blank, and blank. The cells across a tenth row 140 are labeled "B", "Bunker", blank and blank.

Turning now to FIG. 7, said scorecard 90, in addition to displaying rules for using each club, provides an area for keeping score for the number of shots or moves taken by each player on each hole on the façade 92 of said scorecard 90. An area is provided on said scorecard 90 where players may place their handicaps next to their names for playing an alternative embodiment in which players reflect their true capabilities in playing real golf.

Referring to FIG. 8, rules for club use for the preferred embodiment of the present golf board game 10 described herein and illustrated in the drawings are displayed on the back 94 of said scorecard 90 are provided as follows: A short iron is recommended for playing out of a fairway bunker 63. A pitching wedge is recommend for playing out of a group of trees 66 or bushes 65. A sand iron must be used to move out of a greenside bunker 60. A putter may be used only on a green area 37. Said back 94 of said scorecard 90 provides blank spaces to allow players to add their own rules for club use as an alternative embodiment.

The present golf board game 10 is made of typical materials known in the art.

Exemplary Rules of Play:

The object of the present golf board game 10 is to complete the game, which is a round of golf, with the fewest number of strokes. To achieve the object, the challenge is to choose the most suitable golf club for each shot/move and to decide when to take a risk and when to play safe when encountering hazards, obstructions and the like.

To initiate game play for the preferred embodiment of the golf board game 10 described herein and illustrated in the drawings, each player throws the die 100 on the game board 20, illustrated in FIGS. 1, 2, and 3, to determine which player moves a token 70 first. The first player to tee off and begin moving his token 70 forward, is the player who rolls the highest number of eyes 104 on face 102 of the die 100 turned upwardly. The second highest roller goes next and so on. After all players have moved their tokens 70 forwardly on said game board 20 once starting with the first hole tee box space 52, each token 70 or ball is declared to be in play, and the order of the play follows normal golf rules, such that the player whose token 70 is farthest from the flag 36 is the first to play the next shot or, in other words, to make the next move. The play order on successive tee box spaces 32 is determined by the result of the previous hole, with the player whose token 70 reaches the flag 36 with the least number of strokes or moves being declared the winner of the hole and thus being first player to cast the die 100 and move his token 70 forwardly on the next hole. The movement of the token 70 depends on which golf club is being used by a player and the roll of the die 100. Before rolling the die 100, a player must decide and declare which club he intends to use, following rules for club use illustrated on the back 94 of a scorecard 90. A sand iron must be used to move out of a greenside bunker 60 and a putter may be used only on a green area 37. After rolling the die 100, the player's token 70 should be moved the number of spaces indicated by the numbers in the Distances and Outcome chart as shown on the front side 82 of a list card 80, illustrated in FIG. 4, and following rules for taking a next shot depending on the position of such player's token 70 on the game board 20, as provided on a rear side 84 of said list card 80, shown in FIG. 6. Rules providing the number of spaces a player may move such player's token dependent upon 1) the number of eyes 104 facing upwardly on a face 102 of said die 100 after a player throws said die 100, 2) the number of spaces indicated in the distances and outcome table for the roll of the die 100, the club used by such player, and for a putter, the number of spaces on the green area 37 from the token 70 ball to the flag 36, which is as follows: Clubs listed on said list card 80 are selected from the group consisting of driver, 3-wood, 5-wood, long iron, medium iron, short iron, pitching wedge, sand iron, lob wedge, and putter. Using a driver, a token 70 is moved forwardly 10L spaces for a 1-roll, 10 spaces for a 2-roll, 11R spaces for a 3-roll, 11 for a 4-roll, 12 for a 5- or 6-roll. If a player uses a 3-wood, such player may move his token 9 L for a 1-roll or 9 for a 2-roll, 10R spaces for a 3-roll, 10 spaces for a 4-roll, 11 spaces for a 5- or 6-roll. If a player uses a 5-wood, such player may move his token 8L spaces for a 1-roll of the die 100, 8 spaces for a 2-roll, 9R spaces for a 3-roll, 9 spaces for a 4-roll, 10 for a 5- or 6-roll. Using a long iron, a player moves his token 7L spaces for a 1-roll of die 100, 7 spaces for a 2-roll, 8R spaces for a 3-roll, 8 spaces for a 4-roll, 9 spaces for either a 5- or 6-roll. If a player uses a medium iron, such player may move his token 6 spaces for either a 1-, 2-, or 3-roll, and 7 spaces for either a 4- or 5-roll, and 8 spaces for a 6-roll. Using a short iron, a token 70 is moved 5 spaces forwardly for a 1- or 2-roll, 6 spaces for a 3-, 4-, or 5-roll, and 7 spaces for a 6-roll. Using a pitching wedge, a token is moved 3 spaces for a 1-roll, 4 spaces for a 2- or 3-roll, 5 spaces for a 4- or 5-roll, and 6 spaces for a 6-roll. Using a sand iron, a token is moved 0 spaces for a 1-roll, 1 space for a 2-roll, 2 spaces for a 3- or 4-roll, 3 spaces for a 5-roll, and 4 spaces for a 6-roll. Using a lob wedge, a token is moved 1 space for a 1-roll, 2 spaces for a 2- or 3-roll and 3 spaces for a 4-, 5- or 6-roll.

If a token 70 lands on a flag 36 from a fairway space 37, without prior entry onto a green area 37 of that particular golf link 21, then whether a Hole-in-One has been attained must be determined. A Hole-in-One occurs when a player twice throws the same number of eyes 104 on the die 100 as were shown on the die 100 by which the player originally landed upon such flag 36. In this event, no putting is necessary. Thus, a Hole-in-One is attained on a Par 3 golf link 21 or an Eagle is attained on a Par 4 or Par 5 golf link 21.

An example of a set rules for using a putter, according to the preferred embodiment of the present golf board game 10 described herein and illustrated in the drawings is as follows: 2 strokes are taken if a token 70 is 0 spaces on the green area 37 to the flag 36 and the roll on the die 100 is 1 or 2. 1 stroke is taken if the token is 0 spaces on the green area 37 to the flag 36 and a 3, 4 or 5 is rolled. If a token is 1 space on the green area 37 from the flag 36 and 1 is rolled, 3 strokes are taken; however, 2 strokes are taken if 2 or 3 is rolled, and 1 stroke is taken if 4, 5 or 6 is rolled. If a token is 2 spaces on the green area 37 from the flag 36, 3 strokes are taken for rolling 1 or 2, while 2 strokes are taken for rolling 3 or 4 and 1 stroke is taken for rolling 5 or 6. If a token is 3 through 6 spaces on the green area 37 from the flag 36, 3 strokes are taken if 1, 2, or 3 is rolled, while 2 strokes are taken on a 4- or 5-roll, and 1 stroke is taken for a 6-roll.

Using symbols and penalties as illustrated in FIG. 6 to determine movement of a player's token 70 dependent upon various obstructions, hazards, or terrain and to determine whether a player has to take an extra stroke to add to his score as follows: If a player's token 70 lands on an unplayable area, the player takes one stroke and takes his next shot from 2 spaces back on numbered spaces. Said unplayable area does not have a symbol, but is a location on said game board 20 from which a token may not be moved forwardly. If a token 70 lands on a tree 66, no strokes are taken and the token 70 must be played from where it lies. If a player's token 70 lands upon a water hazard 64 or upon a bridge 69, but not due to a hook or slice, the player's next token 70 move will be from 1 space behind the water hazard 64 and the player must add 1 to his score for the hole. If a player's token 70 lands on a water hazard 64 due to a hook or slice, the next move of the token 70 will take place from one space behind the numbered space from where the token 70 entered into the water hazard 64. If a player's token lands upon a fairway space 34 marked "Lost Ball" or on an out-of-bound, the player's token 70 must be moved back to the space from where the original token 70 was last played and must add 1 to his score for the hole. If a player's token 70 lands in a bush 65, the player must place a second token 70 on the spot where his first token 70 was played and the player throws a die 100. If a 1 is thrown, the ball is played as a Lost Ball; provided, however, if any other amount is thrown, the player continues to play from the first token's 70 position.

From the last fairway space 34 before entering the green area 37 or from the off-green space 48, a player must always choose the middle route 54, the left route 55, or the right route 56 in which the flag 36 is located. Also, if a move forward to the green area 37 goes beyond such green area 37, the token 70 is considered to be over the green and should be placed on the off-green space 48, regardless of the number of eyes 104 showing on the face 102 of the die 100 turned upwardly. In addition, when a move to the green area 37 occurs with a hook or slice, the token 70 will be positioned to the outside of the green area 37 on the greenside area 59 to the left or to the right, respectively, of the space in the green area 37 where the token 70 would otherwise have landed. When making the next move from a space in the greenside area 59, the token 70 may only be moved in a horizontal direction until it is on the green area 37, regardless of the position of the flag 36. Crossing a space on and around the green area 37 counts as a move of one space. Further, in case a token 70 hits a water hazard 64 to the left or right of a green area 37, the player must make the next move from the last fairway space 34 of the hole, which is in front of the green area 37. If a hazard such as a fairway bunker 63 or water hazard 64 occupies the last fairway space 34, the next move would be from the fairway space 34 behind such hazard. After playing each hole, the number of strokes/moves taken by each player for each hole is recorded on the façade 92 of a scorecard 90. The player taking the least amount of total moves for all holes is the winner. The player taking the second least amount of total moves for all holes is the second-place winner and so on.

In other embodiments of said golf board game 10, players may play a game in any format of stroke play or match play used in real golf or may use handicaps. In still another embodiment, players may create their own Distances and Outcomes chart by changing the parameters to reflect their own capabilities in true golf. For instance, the parameters could be changed such that the lower a player's handicap is, the more the outcome would cluster around a higher number of strokes while, conversely, as a handicap increases, the outcome would have a wider spread to cluster around a lower number of strokes. The outcomes for putting would similarly reflect better or poorer capabilities.

With respect to the above description then, it is to be realized that the optimum dimensional relationships for the parts of the present golf board game to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A golf board game comprising:

a cube-shaped die having six faces, each such face bearings a non-duplicated number of eyes from 1 to 6;

a plurality of tokens, each token representing a golf ball;

a plurality of scorecards, each scorecard comprising:

a façade providing an area for keeping score for the number of shots or moves taken by each player on each hole and for placing a handicap next to each player's name; and a back providing rules for club use;

a plurality of cards comprising:

a front side bearing a chart of distances and outcome providing the number of spaces to move a token based upon a roll of said die, a club, other than a putter, selected by a player said chart further comprising:

a first area having a club column and six sequentially numbered columns with labels selected from the group consisting of 1, 2, 3, 4, 5, and 6 representing the number of eyes on said face of said die facing upwardly upon a roll of said die and a plurality of rows labeled as clubs selected from the group consisting of DRIVER, 3-WOOD, 5-WOOD, LONG IRON, MEDIUM IRON, SHORT IRON, PITCHING WEDGE, SAND IRON, LOB WEDGE, and PUTTER wherein each intersection of a club column or numbered column and a row is cell representing the number of spaces to move a token and the position of such token on a landing space or to the right or left of such landing space; and a second area labeled "PUTTING" having club column and numbered column representing the number of eyes on a face of a die facing upwardly upon a roll of said die, said club column and numbered column appearing as extensions of said club column and numbered column of said first area and further comprising a plurality of rows selected from the group 0, 1, 2, and 3-6 representing the number spaces a token on the green area is from a flag, wherein each intersection of said club column or said numbered column and a row is a cell representing the number of moves a player must add to such player's score; and a rear side providing rules for applying penalties for landing a token on a space or area bearing a symbol representing a golf event or on an space or area from which said token is unplayable; and a game board comprising:

a flat surface having a left half portion and a right half portion continuously joined at a flexible seam, said left half portion further comprising a left front edge, a left side edge, a left rear edge and said right half portion further comprising a right front edge, a right side edge and a right rear edge;

a plurality of non-rough areas;

a plurality of rough areas;

a representation of a club house imprinted on said game board;

eighteen sequentially numbered golf links imprinted on said game board, each golf link further comprising:

a tee box space imprinted with a Par and Stroke Index box space;

a plurality of sequentially numbered fairway spaces representing distance to a flag on a green area from said tee box space;

an obround green area having a grid comprised of a middle route, a left route and a right route defined by an inner circle and bearing a flag, said green area further comprising:

a round center space;

said inner circle surrounding said center space having a semi-circular inner green space located between said center space and a playing space positioned between a highest numbered fairway space and said inner circle and also having another semi-circular outer green space on an opposite side of said inner green space; and an outer circle surrounding said inner circle having an inner grid space positioned between a highest numbered fairway space and said inner circle and an outer grid space positioned between said semi-circular outer grid space and an off-green space; and an off-green space positioned to an outside of a green area, adjacent to said outer grid space, said off-green space representing an area in which a golf ball is over-hit and said off-green space being sequentially numbered along with said fairway spaces, said inner grid space, inner green space, center space, outer green space, and outer grid space to form said middle route of said green area; and a greenside area; and at least one alternative route on a golf link, said alternative route comprising a plurality of said fairway spaces sharing a beginning space with first fairway space of a golf link, continuing on a deviated path, and an ending space with another fairway space of a golf link; and a plurality of symbols imprinted on said game board, each of said symbols representing a golf event.

2. The golf board game of claim 1 wherein said golf event is selected from the group consisting of a water hazard, a tree, a group of trees, a bush, a group of bushes, a fairway bunker, a greenside bunker, a bridge, a lost ball, or out-of-bounds identified by said symbols imprinted on said game board.

3. The golf board game of claim 2 wherein said rules for golf club use provide that sand iron must be used to move out of a greenside bunker.

4. The golf board game of claim 3 wherein said rules for golf club use provide that a putter may be used only on a green area.

5. The golf board game of claim 4 wherein each of said token further comprises a dimpled surface.

6. The golf board game of claim 1 wherein a plurality of stick-on flags are provided as an alternate to flags imprinted on said game board.

* * * * *